US011359614B2

(12) United States Patent
Chen et al.

(10) Patent No.: US 11,359,614 B2
(45) Date of Patent: Jun. 14, 2022

(54) POWER HEAD OF VERTICAL RECIPROCATING PUMP WITH MULTI-SPHERICAL CONNECTION, AND WATER INJECTION PUMP USING THE SAME

(71) Applicant: NINGBO HELI MECHANICAL PUMP CO., LTD., Zhejiang (CN)

(72) Inventors: Minghai Chen, Zhejiang (CN); Yingfeng Chen, Zhejiang (CN); Heping Liu, Zhejiang (CN)

(73) Assignee: NINGBO HELI MECHANICAL PUMP CO., LTD., Zhejiang (CN)

( * ) Notice: Subject to any disclaimer, the term of this patent is extended or adjusted under 35 U.S.C. 154(b) by 213 days.

(21) Appl. No.: 16/641,654

(22) PCT Filed: Jul. 1, 2019

(86) PCT No.: PCT/CN2019/094176
§ 371 (c)(1),
(2) Date: Feb. 25, 2020

(87) PCT Pub. No.: WO2020/015518
PCT Pub. Date: Jan. 23, 2020

(65) Prior Publication Data

US 2021/0164454 A1 Jun. 3, 2021

(30) Foreign Application Priority Data

Jul. 18, 2018 (CN) ..... 201810788724.5
Jun. 28, 2019 (CN) ..... 201910571143.0

(51) Int. Cl.
*F04B 1/14* (2020.01)
*F04B 1/124* (2020.01)
*F04B 53/10* (2006.01)

(52) U.S. Cl.
CPC ..... *F04B 1/124* (2013.01); *F04B 1/14* (2013.01); *F04B 53/10* (2013.01)

(58) Field of Classification Search
CPC .. F04B 9/04; F04B 9/042; F04B 1/146; F04B 1/148; F04B 1/126; F04B 27/0882; F04B 1/124; F04B 1/14; F04B 53/10
(Continued)

(56) References Cited

U.S. PATENT DOCUMENTS 586,877 A * 7/1897 Sparks ..... F01B 3/0052 91/499
2,430,764 A * 11/1947 Gabriel ..... F04B 1/2035 417/222.1

(Continued)

FOREIGN PATENT DOCUMENTS

CN 102155370 8/2011
CN 104421124 3/2015

(Continued)

OTHER PUBLICATIONS

Machine Translation of German Patent DE 2709985 A1 to Prang, Hans-Juergen published Sep. 14, 1978 (Year: 1978).*

(Continued)

*Primary Examiner* — Essama Omgba
*Assistant Examiner* — Dnyanesh G Kasture
(74) *Attorney, Agent, or Firm* — JCIP Global Inc.

(57) ABSTRACT

The present invention discloses a power head of a vertical reciprocating pump with multi-spherical connection, and a water injection pump using the same, which includes a hydraulic end, a centralizing sleeve, an adjustable ball seat, a circular pull-back plate, pull rods of the power head, and a hydraulic end, an integrated base and the alike. By using the structure with multiple movable spherical surfaces, the error of the oblique disk during its motion along the elliptic (Continued)

trajectory can be eliminated. The power end can be linked with hydraulic ends and can be applied to boosting water injection processes for feeding liquid at low pressure or feeding liquid at high pressure in oil fields and various high-pressure liquid delivery fields. The fast on-site installation of the water injection pump of the present invention can be realized by the integrated base, so as to save the investment and improve the safety factor.

10 Claims, 7 Drawing Sheets

(58) Field of Classification Search
USPC ..... 248/679; 91/499
See application file for complete search history.

(56) References Cited

U.S. PATENT DOCUMENTS 2,601,830 A * 7/1952 Berlyn ..... F04B 1/22 91/488
2,684,630 A * 7/1954 Widmer ..... F04B 49/12 417/222.1
3,249,052 A * 5/1966 Karlak ..... B01F 15/0454 417/494
3,954,048 A 5/1976 Houser
4,583,921 A * 4/1986 Wolff ..... F04B 1/124 417/269
4,905,577 A * 3/1990 Schneeweiss ..... F16J 1/14 384/245
5,354,181 A 10/1994 Porel
6,616,380 B1 * 9/2003 Russell ..... E02D 29/045 405/229

FOREIGN PATENT DOCUMENTS

CN 107989579 5/2018
CN 108005870 5/2018
CN 108757362 11/2018
CN 208734498 4/2019
DE 2709985 A1 * 9/1978 ..... F04B 1/126

OTHER PUBLICATIONS

"International Search Report (Form PCT/ISA/210) of PCT/CN2019/094176," dated Sep. 19, 2019, with English translation thereof, pp. 1-5.

* cited by examiner

POWER HEAD OF VERTICAL RECIPROCATING PUMP WITH MULTI-SPHERICAL CONNECTION, AND WATER INJECTION PUMP USING THE SAME

CROSS-REFERENCE TO RELATED APPLICATION

This application is a 371 of international application of PCT application serial no. PCT/CN2019/094176, filed on Jul. 1, 2019, which claims the priority benefit of China application No. 201810788724.5, filed on Jul. 18, 2018 and the Chinese patent application No. 201910571143.0, filed on Jun. 28, 2019. The entirety of each of the above mentioned patent applications is hereby incorporated by reference herein and made a part of this specification.

TECHNICAL FIELD OF THE INVENTION

The present invention relates to a power head of a vertical reciprocating pump with multi-spherical connection, which can be adapted to various hydraulic ends and applied to boosting water injection processes for feeding liquid at low pressure or feeding liquid at high pressure in oil fields and various high-pressure liquid delivery fields, and a water injection pump using the power head, which realizes water injection into a single well in oil fields, with low pressure at the inlet and high pressure at the outlet or with high pressure at both the inlet and the outlet.

BACKGROUND OF THE INVENTION

Power heads of conventional reciprocating pumps are crankshaft and connecting rod mechanisms for realizing the reciprocating motion. Reciprocating pumps include horizontal reciprocating pumps and vertical reciprocating pumps. However, in spite of this, both horizontal reciprocating pumps and vertical reciprocating pumps are connected to a plunger of a hydraulic end by a crankshaft, a connecting rod, a crosshead and an intermediate rod, and the crankshaft is driven to rotate by a motor. The connecting rod rotates and reciprocates in the crank of the crankshaft to drive the crosshead, the intermediate rod and the plunger to do a reciprocating motion, to complete the liquid feeding and discharge by a liquid feed valve and a liquid discharge valve at the hydraulic end, thus to realize the function of the reciprocating pump.

At present, during the water injection for secondary oil recovery in an oil field, the water injection often fails due to the rise of injection pressure at some wells. In this case, boosting water injection is used. Devices for boosting water injection generally include: plunger-type hydraulically-balanced horizontal reciprocating pumps, multi-section centrifugal pumps, pressure-differential hydraulic piston pumps, hydraulically-balanced pumps, etc. In those devices, the hydraulic balance is realized by a difference between the pressure at the inlet and the pressure at the output, to satisfy the lubrication conditions for moving members at the power head, in order to avoid the heat generation at the power head, due to unbalance, which may influence the pump's operation.

The boosting water injection process generally adopts multi-well augmented injection, in which the augmented injection is performed by one device after ranking wells at a similar pressure. Among conventional augmented injection devices, reciprocating plunger booster water injection pumps are the most commonly used and have higher efficiency than relative devices. However, there are some disadvantages such as low unbalance rate of pressure difference and narrow range of application. The unbalance of pressure difference will directly influence the normal operation of the device. The pressure difference refers to a difference between the pressure at the outlet and the pressure at the inlet. This pressure difference is often the basis for designing booster pumps. Since the pressure difference depends upon the geological conditions provided by oil field users, it is very difficult to achieve a certain accuracy (sometimes, even below 50%) between the provided pressure difference and the final actual pressure difference during the pump's operation.

At present, most of low-in-high-out water injection and centralized water injection methods used in oil fields, in which multiple wells are injected by one pump, require water injection stations, supplemented by high-pressure pipelines, high-pressure gates and other auxiliary facilities. The investment is high, and there are various high-pressure safety risks. Therefore, in order to realize green, environmentally-friendly and safe oil fields, it is necessary to take measures such as no high-pressure components on the ground, injection to a single well by a single pump, quality improvement and efficiency enhancement. Therefore, it is imperative to develop a power head and a water injection pump, which can be on-site installed in a single well and can be universally applied to water injection processes with low pressure at the inlet and high pressure at the outlet or with high pressure at both the inlet and the outlet, to replace the existing centralized water injection or water injection into multiple wells by a single pump.

SUMMARY OF THE INVENTION

In view of the current situation of the prior art, a first technical problem to be solved by the present invention is to provide a power head of a vertical reciprocating pump with multi-spherical connection, which can be matched with various hydraulic ends and applied to boosting water injection processes for feeding liquid at low pressure or feeding liquid at high pressure in oil fields and various high-pressure liquid delivery fields.

Another technical problem to be solved by the present invention is to provide a water injection pump using this power head, which realizes water injection into a single well in oil fields, with low pressure at the inlet and high pressure at the outlet or with high pressure at both the inlet and the outlet, and which can realize rapid on-site installation, save the investment and improve the safety factor.

To solve the first technical solution, the power head of a vertical reciprocating pump with multi-spherical connection includes: a machine body which is a vertical cylinder shape; an oblique plate which is connected to an output shaft of a power source and has a shaft portion and a planar cam portion which is beveled; a centralizing sleeve which is disposed below the planar cam portion of the oblique plate, a thrust ball bearing being disposed between opposite surfaces of the centralizing sleeve and the oblique plate; an adjustable ball seat which is slidingly disposed on the shaft portion of the oblique plate, and the bottom of which is provided with a reset spring capable of automatically resetting the adjustable ball seat; a pull-back plate which is disc shape and has a plurality of through holes uniformly distributed along the circumference, the pull-back plate being disposed below the centralizing sleeve through the adjustable ball seat, and the adjustable ball seat being in spherical sliding fit with the pull-back plate; pull rods, the number of which is the same as the number of plungers of each hydraulic end, the pull rods having a lower end connected to the plunger of each of the hydraulic ends of the reciprocating pump and an upper end arranged in the through hole on the pull-back plate, head portions of the pull rods being convex spherical surfaces capable of rotating and sliding, and opposite surfaces of the pull rods and the centralizing sleeve being linked by movable balls; wherein, the oblique plate, the centralizing sleeve, the adjustable ball seat, the pull-back plate and the pull rods are all disposed in the machine body, and the upper portion of the machine body is connected to the power source while the lower portion thereof is connected to the hydraulic end of the reciprocating pump; and, under the rotation of the oblique plate, the pull-back plate is driven to swing up and down during its reciprocating motion by the thrust ball bearing, the centralizing sleeve and the movable balls, so that the pull rods and the plunger are driven to reciprocate up and down without interference.

Preferably, the planar cam portion of the oblique plate is of a uniform-thickness structure for controlling the dynamic balance torque, and a groove for accommodating the thrust ball bearing is formed on an inner slope of the planar cam portion to bear an axial thrust from the pump during its rotation; two ends of the shaft portion are positioned in an inner hole of the machine body and in an inner hole of the pump body at the hydraulic end, and an inner hole and an inner key, to which the output shaft of the motor is directly connected, are formed on the top of the shaft portion, so that easy assembly and high precision can be ensured; and upper and lower bearings are disposed on the outer diameter of the shaft portion to balance a radial force and an axial force so as to avoid the shaft play.

Preferably, the centralizing sleeve is an annular ring having: an upper plane and a lower plane; an annular groove is formed on the upper plane for accommodating a lower seat of the thrust ball bearing; and hemispherical surfaces are formed on the lower plane for accommodating the movable balls. The number of the hemispherical surfaces is determined by the number of cylinders at the hydraulic end; each of the hemispherical surfaces and a hemispherical surface on the upper plane of the pull rod share one movable ball; the number of the cut bocks is determined according to the annular distance; the centralizing sleeve is linked with the thrust ball bearing and the pull rods to eliminate the error of the oblique plate during its motion along an elliptic trajectory, so that the rotation of the oblique plate can be converted into the reciprocating motion of the pull rods to eliminate the error.

Preferably, the adjustable ball seat is a non-rotatable sliding reciprocating member which is configured in such a way that, in the inner hole, a sliding bearing is in fit with a journal of a middle section of the oblique plate, and on the outer diameter, a convex spherical surface is in sliding fit with the spherical surface of the pull-back plate, so that the pull-back plate disposed on the adjustable ball seat can slide on the spherical surface of the adjustable ball seat along with the reciprocating motion of the pull rods; and, a number of self-rotating rollers are disposed on a lower end surface of the adjustable ball seat to form a planar bearing. By automatically resetting the adjustable ball seat through the reset spring, the moving member eliminates the error caused during the motion along an elliptic trajectory by the sliding aligning operation when the multi-spherical members are slidingly linked.

Preferably, the pull-back plate can be in direct sliding fit with the pull rods, that is, the through holes on the pull-back plate can be configured as spherical through holes to form concave spherical surfaces which are fitted with the convex spherical surfaces of the head portions of the pull rods; and, the inner hole in the center of the pull-back plate is configured as an inner sphere that is in fit with the convex spherical surface of the adjustable ball seat. Thus, the pull-back plate is a non-rotatable member which moves up and down. When the pull rods are reset, the convex spherical surfaces of the pull rods can be lifted up by the concave spherical surface on the pull-back plate to swing up and down during the reciprocating motion. Since a number of sliding spherical surfaces are disposed to enable the linkage of the pull rods and the plunger to reciprocate without interference, the power head can be matched with the hydraulic ends of various vertical reciprocating pumps to deliver various liquids with low pressure at the inlet and high pressure at the outlet or with high pressure at both the inlet and the outlet.

Preferably, the convex spherical head portions of the pull rods are hemispheres, outside which convex spherical surfaces fitted with the concave spherical surfaces are formed to pull the pull rods back to the original positions during the rotation of the oblique plate; and hemispherical surfaces for accommodating the movable balls are formed on an upper plane.

More preferably, in order to control and adjust the gaps among the pull rods, the centralizing sleeve and the oblique plate due to the assembly, motion friction, motion component force and the like, to realize the synchronous reciprocation of the pull-back plate and the oblique plate and to ensure the synchronous pullback of the plungers, a mechanism capable of realizing synchronous reciprocation and adjusting the axial gaps between moving members can be additionally disposed at the power head described above. The mechanism can include: a positioning sleeve, which is sheathed outside the oblique plate and the centralizing sleeve, and a lower end of which is fixed to the pull-back plate; a planar bearing device, which is disposed on an outer slope of the planar cam portion of the oblique plate, and the planar bearing device includes a synchronous-rotation bearing seat disposed on the outer slope, an upper bearing rail and a steel ball disposed on a holder between the bearing seat and the upper bearing rail. The upper bearing rail and the upper end of the positioning sleeve are fixed together, and a gap pad can be disposed between the upper bearing rail and the upper end of the positioning sleeve according to the requirements of the axial gap between the upper bearing rail and the positioning sleeve.

In this way, the pull-back plate and the oblique plate are fixed as a whole by the positioning sleeve, and a synchronous-rotation planar bearing device is disposed on the rear surface of the oblique plate, so that the interference to the reciprocating motion of the pull-back plate by the oblique plate during its rotation is eliminated, and the impact on the pump efficiency, which is resulted from the stroke loss due to the gaps between the moving members during the operation of the oblique plate, is effectively avoided. By using the structure of synchronously reciprocating the pull-back plate and the oblique plate, it is ensured that the reciprocation of the plungers is not influenced by the gaps and the plungers are synchronously pulled back in the whole stroke.

Further, the direct sliding fit of the pull-back plate and the pull rods can be changed, a sliding seat is disposed between the pull-back plate and each pull rod, and a concave spherical surface in sliding fit with the convex spherical head portion of the pull rod is formed on the sliding seat. In this way, the elliptic error caused during the synchronous reciprocation of the pull-back plate and the oblique plate can be adjusted by the sliding seats, and it is ensured that the pull rods do not interfere with the centralizing sleeve during operation.

In order to solve the above-described another technical problem, the water injection pump includes:

the power head;

a hydraulic end integrally linked with the power head, the hydraulic end includes:

a pump body, in which plungers and combined valves each having a liquid feed valve and a liquid discharge valve integrated with each other are disposed according to the number of cylinders, wherein an annular liquid feed cavity and an annular liquid discharge cavity are disposed at a lower central portion of the pump body; the annular liquid feed cavity is communicated with a suction port of each combined valve, and the annular liquid discharge cavity is disposed below the annular liquid feed cavity and communicated with a liquid discharge port of each of the combined valves; and a liquid feed flange and a liquid discharge flange, which are respectively connected to external feed and discharge manifolds, are disposed on an outer circle of the pump body; and an integrated base, by which the water injection pump is integrally mounted at a predetermined position.

Preferably, the feed manifold and the discharge manifold are connected to a water injection manifold on an edge of an oil well tree, wherein the liquid feed flange is linked with a high-pressure pipeline gate valve in a low-pressure pipeline or water injection manifold through a gate valve, an elbow and a feed pipeline to serve as a low-in-high-out or high-in-high-out water feed source and an inlet for linking a water pump, respectively; and the liquid discharge flange is connected to a high-pressure pipeline gate valve in the water injection manifold through a check valve, a high-pressure pipeline, an elbow and a high-pressure gate valve, so that high-pressure liquid pressurized in a low-in-high-out or high-in-high-out manner is injected into the water injection manifold.

Preferably, the integrated base is a fast integration part required by on-site installation of a single-well water injection pump. The integrated base includes a prefabricated concrete block, an embedded bolt and concrete dry powder slurry. The bottom of the pump body is fixed with the prefabricated concrete block through the embedded bolt. The prefabricated concrete block is cylindrical, and a spiral groove is formed on an outer circle of the prefabricated concrete block.

Preferably, the pull rods and the plungers can be positioned and linked by clamps. The outer circle of each of the pull rods is cylindrical and each of the pull rods is provided with the sliding sleeve (bearing), so that a guide effect can be achieved during the reciprocating motion.

Compared with the prior art, the present invention has the following advantages.

With regard to the power head of a vertical reciprocating pump with multi-spherical connection in the present invention, during the rotation of the oblique plate, the slope is moved down to transfer the rotation to the centralizing sleeve through the thrust ball bearing, and the spherical surface of the lower plane of the centralizing sleeve transfers the rotation to the spherical surfaces of the upper planes of the pull rods, and the pull rods are pushed to the front dead point by the rotation of the spheres. When the oblique plate is rotated by 180°, the slope is moved up, and the spherical surfaces of the pull rods are lifted up by the spherical surfaces of the pull-back plate and then pulled back to the rear dead point. So far, one reciprocating stroke is completed. For the thrust ball bearing sliding on the oblique plane of the oblique plate, the motion trajectory is elliptic. When the pull rods reciprocate for one stroke, the pull-back plate eliminates the error of the oblique plate during its motion along the elliptic trajectory in the multi-spherical sliding process. The rotation motion of the oblique plate is converted into the reciprocating motion to pull the pull rods and the plungers back so as to activate the reciprocating valve sets. Therefore, by using the structure with multiple movable spherical surfaces, the error can be eliminated by multi-spherical sliding when the rotation of the oblique plate along the regular circular by 180° is converted into the motion along the elliptic trajectory during the pullback of the pull-back plate, without interference. However, by using the structure of synchronously reciprocating the pull-back plate and the oblique plate and the axial gap adjustment mechanism, it is ensured that the reciprocation of the plungers is not influenced by the gaps and the plungers are synchronously pulled back in the whole stroke; and, the decreased pump efficiency resulted from the stroke loss caused by the gaps is effectively solved.

The power head can be linked with hydraulic ends of valve sets of various structures, can be set according to different conveying mediums, and can be applied to boosting water injection processes for feeding liquid at low pressure or feeding liquid at high pressure in oil fields and various high-pressure liquid delivery fields.

The fast on-site installation of the water injection pump of the present invention can be realized by the integrated base. The feed manifold and the discharge manifold are arranged to be directly connected to a water injection manifold of an oil field tree, so the single-wall water injection process is realized, and the integrated design of the low-in-high-out or high-in-high-out water injection process of wellheads is realized. The water injection pump can be implemented and applied under two different inlet pressures, i.e., under an inlet pressure of ≤1 MPa and an outlet pressure of 40 MPa or an inlet pressure of 5-20 MPa and an outlet pressure of 15-40 MPa. Thus, a large amount of cost can be saved for oil fields, and various high-pressure safety risks can be reduced.

DETAILED DESCRIPTION OF THE PREFERRED EMBODIMENT

Figure 1:
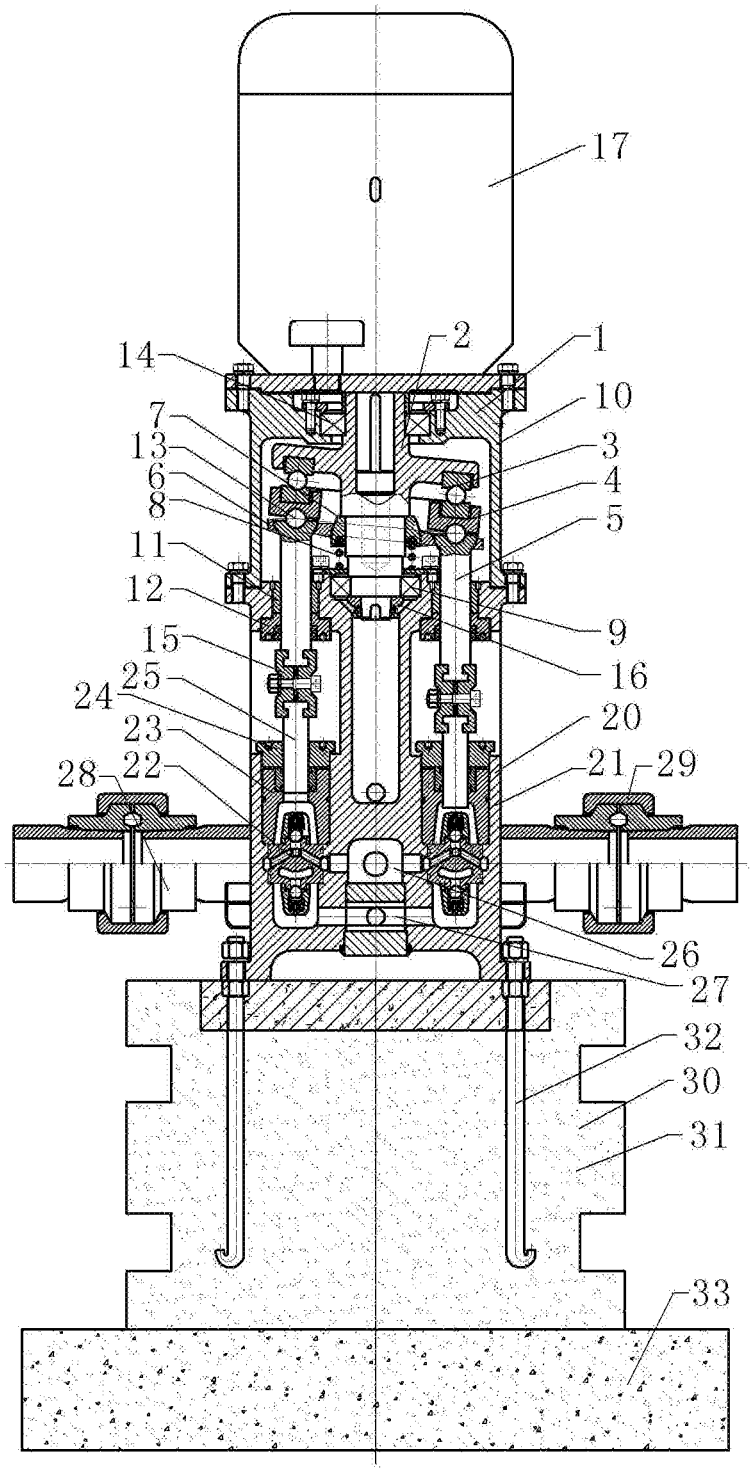
FIG. 1 is a sectional view showing the structure of one embodiment of the present invention.
Figure 10:
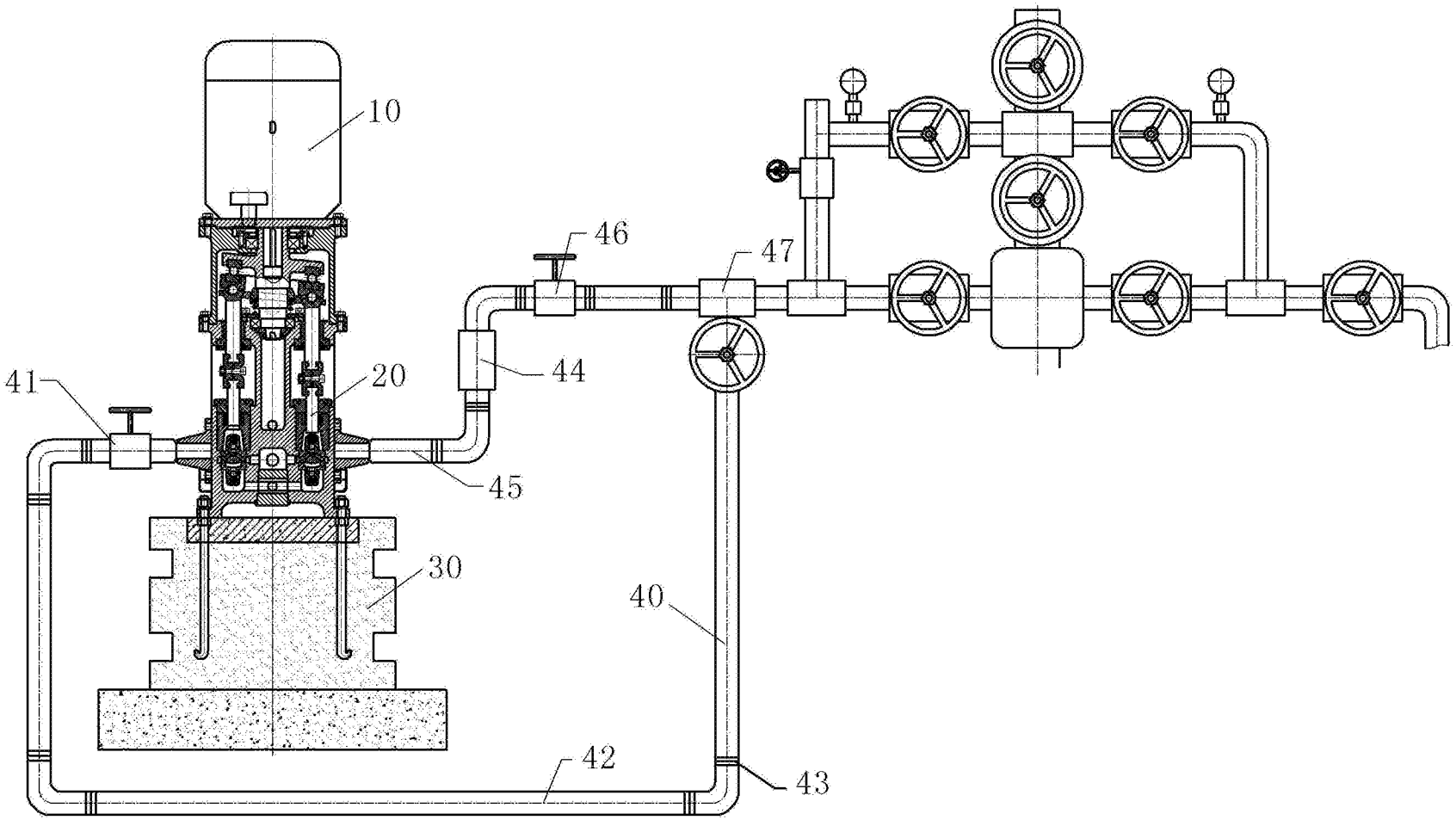
FIG. 10 is a sectional view showing the structure of the water injection pump after being connected to a water injection manifold on the edge of the oil well tree according to the embodiment of the present invention.

To enable a further understanding of the present invention content of the invention herein, refer to the detailed description of the invention and the accompanying drawings below:

Embodiment 1: FIGS. 1 and 10 show an oil field single-well vertical water injection pump equipped with the power head of an embodiment of the present invention. The water injection pump includes a power head 10, a hydraulic end 20, an integrated base 30 and feed and discharge manifolds 40.

Figure 2:
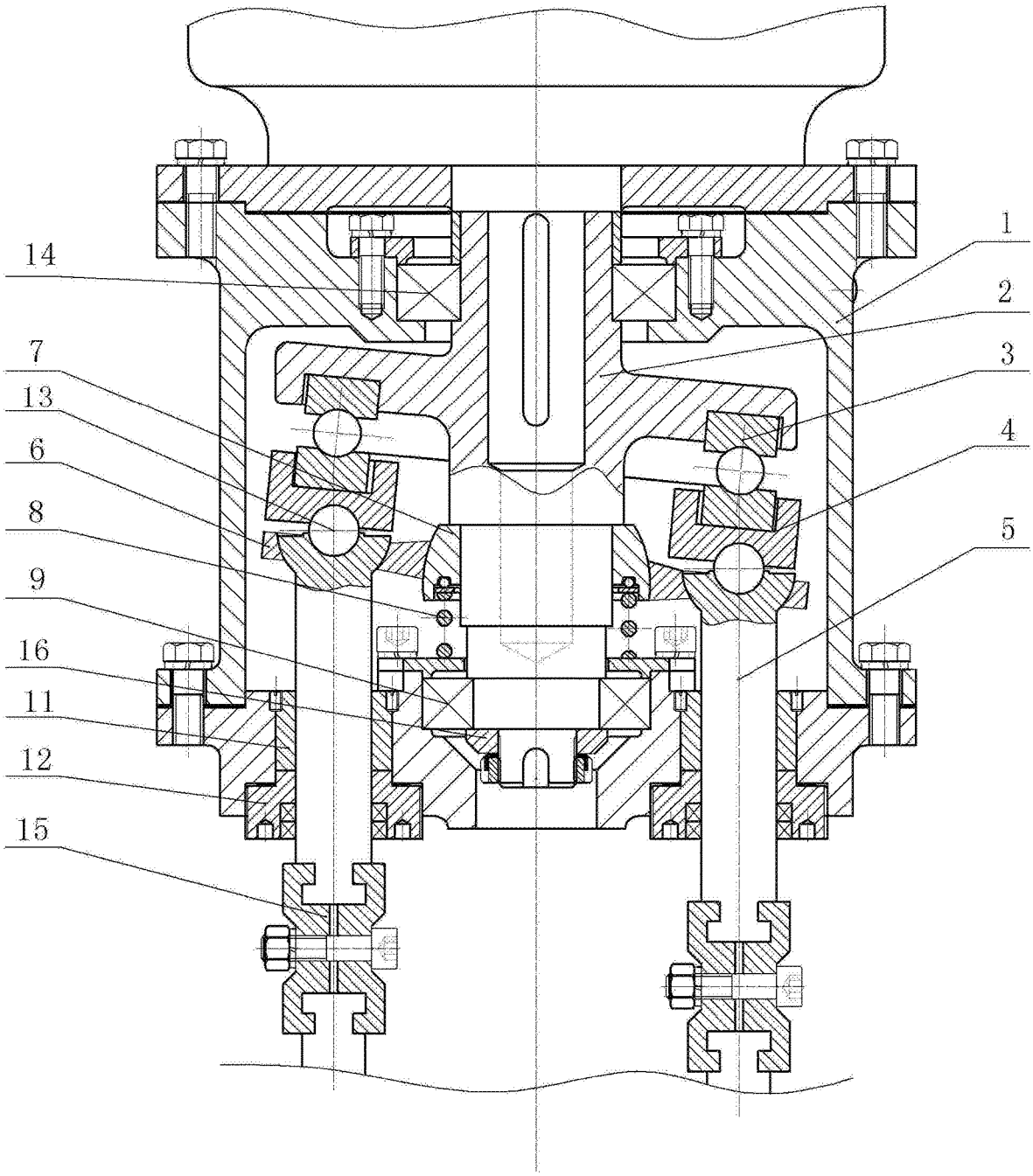
FIG. 2 is a sectional view showing the structure of the power head according to the embodiment of the present invention.

As shown in FIG. 2, the power head 10 mainly consists of a power source 17, a machine body 1, an oblique plate 2, a centralizing sleeve 4, an adjustable ball seat 7, a pull-back plate 6, pull rods 5 and the like. The oblique plate 2, the centralizing sleeve 4, the adjustable ball seat 7, the pull-back plate 6 and the pull rods 5 are all disposed in the machine body 1. The upper portion of the machine body 1 is connected to the power source 17, while the lower portion thereof is connected to the hydraulic end 20 of the water injection pump. The power head can be applied to normal-pressure water supply and pressurized water processes in oil fields and various high-pressure liquid delivery fields. The water injection pump can be implemented and applied under two different inlet pressures, i.e., under an inlet pressure of ≤1 MPa and an outlet pressure of 40 MPa or an inlet pressure of 5-20 MPa and an outlet pressure of 15-40 MPa. The integrated design of the power head is applied to low-in-high-out or high-in-high-out water supply processes. The power head of a reciprocating pump with multi-spherical connection can be matched with various hydraulic ends, to solve and satisfy the requirements of normal-pressure or pressurized water supply in oil fields and various industrial fields. Specifically:

The machine body 1 of the power head is of a vertical cylinder structure provided with upper and lower flanges which can be linked. The upper flange is directly linked with a flange of a motor of the power source, and the lower flange is linked with a flange of a pump body at a hydraulic end and fixed by a bolt. An inner hole for positioning the oblique plate 2 is formed in the center of the upper portion of the machine body 1.

Figure 3:
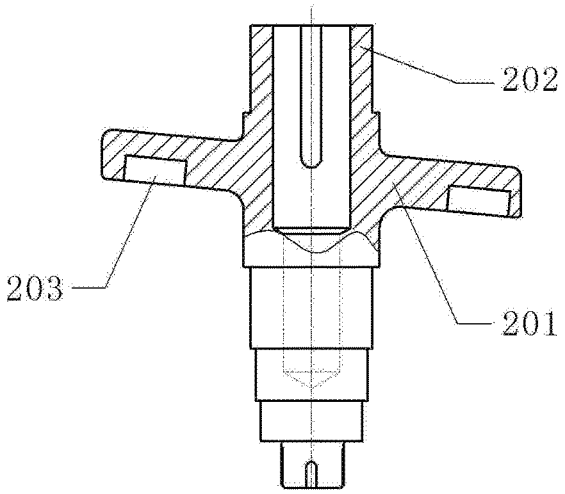
FIG. 3 is a sectional view showing the structure of an oblique plate according to the embodiment of the present invention.

As shown in FIG. 3, the oblique plate 2 is an oblique plate connected with a shaft, and has a shaft portion 202 and a planar cam portion 201 which is beveled. The planar cam portion 201 has a uniform thickness to control the dynamic balance torque. The size of the included angle between slopes of the planar cam portion 201 is determined according to the stroke of the pump. If the stroke is longer, the included angle between slopes is larger; or, if the stroke is shorter, the included angle between slopes is smaller. An annular groove 203 for accommodating a collar of a thrust ball bearing 3 is formed on an inner slope of the oblique plate, to bear the axial thrust from the pump during its rotation. Particularly, in order to control the axial plunger thrust and the axial stress of the fed medium in the reciprocating pump, a lower seat of the thrust ball bearing 3 is positioned in the centralizing sleeve 4. Angular contact bearings are arranged in upper and lower portions of the oblique plate shaft to balance the radial force and the axial force and prevent the shaft play. A sliding bearing crank is disposed in a middle portion of the oblique plate shaft. The upper portion of the oblique plate is positioned in the inner hole of the machine body 1 by an upper rolling bearing 14, while a lower portion thereof is positioned in the inner hole of the pump body 21 at the hydraulic end by a lower rolling bearing 9, and the rolling bearings are fixed on the shaft of the oblique plate by locking caps 16. An inner hole and an inner key are formed on the top of the oblique plate shaft, and the oblique plate shaft is directly linked with a motor shaft of the power source 17, so it is easy to assemble and the precision is high.

Figure 4:
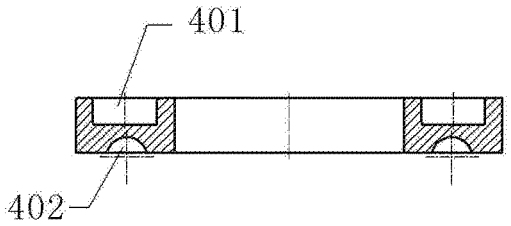
FIG. 4 is a sectional view showing the structure of a centralizing sleeve according to the embodiment of the present invention.
Figure 5:
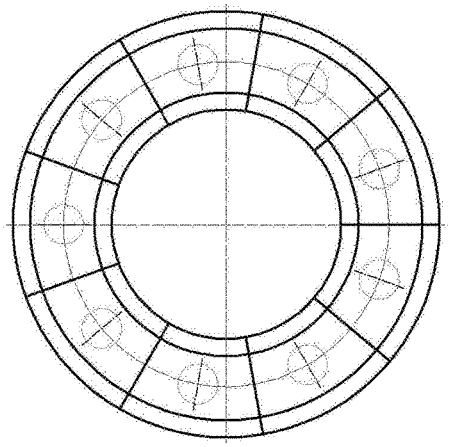
FIG. 5 is a top view of FIG. 4.

The centralizing sleeve 4 is disposed below the planar cam portion 201 of the oblique plate, and is connected to the oblique plate 2 through the thrust ball bearing 3. As shown in FIGS. 4 and 5, the centralizing sleeve 4 is an annular ring. An annular groove 401 is formed on an upper plane for accommodating the lower seat of the thrust ball bearing 3, and hemispherical surfaces 402 are convexly arranged on a lower plane for accommodating movable balls 13. The number of the hemispherical surfaces is determined by the numbers of cylinders at the hydraulic end. The hemispherical surfaces and a hemispherical surface 51 on an upper plane of each pull rod 5 share one movable ball 13. The number of the cut bocks is determined according to the annular distance. The centralizing sleeve is linked with the thrust ball bearing 3 and the pull rods 5 to eliminate the error of the oblique plate during its motion along an elliptic trajectory, so that the rotation of the oblique plate can be converted into the reciprocating motion of the pull rods to eliminate the error.

Figure 7:
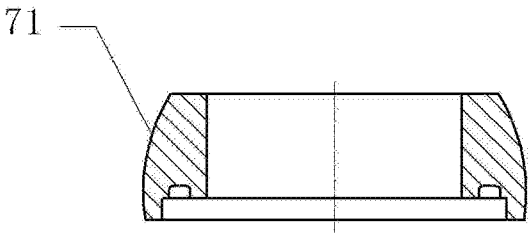
FIG. 7 is a sectional view showing the structure of an adjustable ball seat according to the embodiment of the present invention.

As shown in FIG. 7, the adjustable ball seat 7 is configured in such a way that, in the inner hole, a sliding bearing is in fit with the oblique plate shaft, and on the outer diameter, a convex spherical surface 71 is fitted with the pull-back plate 6. A number of self-rotating rollers are disposed on a lower end surface of the adjustable ball seat to form a planar bearing. A reset spring 8 is provided for automatically resetting the adjustable ball seat 7. Thus, the moving member eliminates the error caused during the motion of the oblique plate 2 along an elliptic trajectory by the sliding aligning operation when the multi-spherical members are linked.

Figure 8:
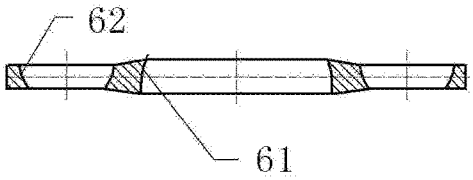
FIG. 8 is a sectional view showing the structure of a pull-back plate according to the embodiment of the present invention.
Figure 9:
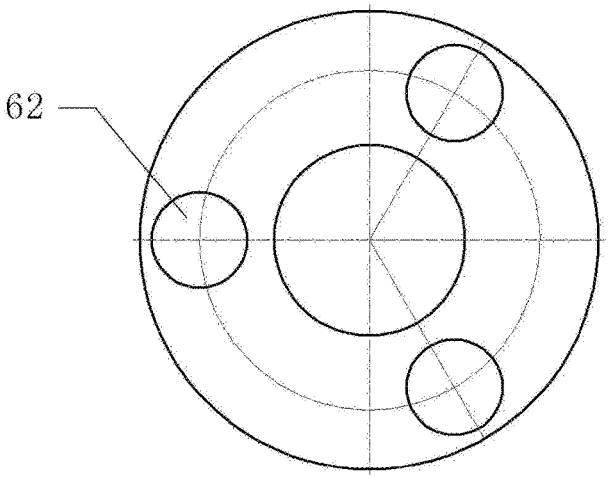
FIG. 9 is a top view of FIG. 8.

As shown in FIGS. 8 and 9, the pull-back 6 is a non-rotatable member which moves up and down, and is an annular tray which looks like a circular disk. Concave spherical surfaces 62 formed by a plurality of spherical through holes are arranged on an annular plane of the pull-back plate 6, with the number of the concave spherical surfaces 62 being the same as the number of cylinders. The concave spherical surfaces 62 are uniformly distributed on a circumferential surface, and are fitted with the convex spherical surfaces 52 of the pull rods 5. The inner hole in the center of the pull-back plate 6 is configured as an inner sphere 61 that is in fit with the convex spherical surface 71 of the adjustable ball seat 7. Since an inner spherical surface fitted with the convex spherical surface 71 of the outer circle of the adjustable ball seat is arranged in the inner hole, when the pull rods 5 are reset, the convex spherical surfaces 52 of the pull rods can be lifted up by the concave spherical surface 62 on the pull-back plate 6 to swing up and down during the reciprocating motion. Since a number of sliding spherical surfaces are provided to enable the linkage of the pull rods and the plunger to reciprocate without interference, the power head can be matched with the hydraulic ends of various vertical reciprocating pumps to deliver various low-in-high-out and high-in-high-out liquids.

Figure 6:
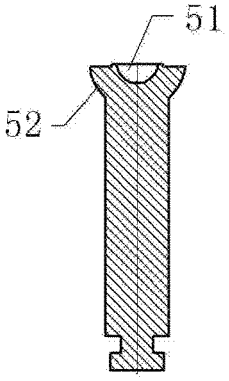
FIG. 6 is a sectional view showing the structure of a pull rod according to the embodiment of the present invention.

As shown in FIG. 6, T-shaped buckles corresponding to T-shaped buckles at the upper ends of the plungers are disposed at lower ends of the pull rods 5, and are fitted with clamps 15 and then fixed by bolts. Two spherical surfaces are arranged at the upper end of each of the pull rods 5. That is, the head portions of the pull rods 5 are hemispheres, outside which convex spherical surfaces 52 fitted with the concave spherical surfaces 62 of the pull-back plate are formed to pull the pull rods back to the original positions during the rotation of the oblique plate 2. Hemispherical surfaces 51 are convexly formed on an upper plane, are linked with the hemispherical surfaces 402 on the lower plane of the centralizing sleeve 4 through balls 13. The outer circle of each of the pull rods 5 is a cylinder fitted with the sliding sleeve 11 (bearing) and an oil seal seat 12, so that the guide effect can be achieved during the reciprocating motion.

The hydraulic end 20 is a cylindrical pump body 21. Plungers 25 are disposed on an upper portion of the hydraulic end 20, the plungers 25 are linked with the pull rods 5 at the power head through clamps, and the plungers 25 are operated vertically or in parallel. Combined valves 22 each having a liquid feed valve and a liquid discharge valve integrated with each other are disposed at a lower portion of the hydraulic end 20. The pump body 32 is of a cylindrical structure, an upper portion of which is provided with a step flange connected to the machine body 1 of the power head. Multiple plungers 25 (3, 5, 7, 9 or more plungers) can be disposed according to the flow. In this embodiment, by taking three cylinders as an example, there are correspondingly three plungers, three pull rods, three convex spherical surfaces of the pull rods and three concave spherical surfaces of the pull-back plate. Three pairs of combined valves 22, packing boxes 23 and compression caps 24 are disposed at the lower portion of the pump body 21. Screw threads are disposed on the compression caps 24 so that the boxes and the valve sets can be positioned in the pump body 21. An annular liquid feed cavity 26 communicated with a suction port of each combined valve 22 is disposed at a lower central portion of the pump body 21, and an annular liquid discharge cavity 27 communicated with a liquid discharge port of each combined valve 22 is disposed below the annular liquid feed cavity 26. A liquid feed flange 28, a liquid discharge flange 29 and a relief valve seat, which are connected with external feed and discharge manifolds 40, are arranged on an outer circle of the pump body 21.

The water injection pump is integrally disposed on a predetermined position by the integrated base 30, so the installation is fast, convenient, firm and effective. The integrated base 30 includes a prefabricated concrete block 31, an embedded bolt 32 and concrete dry powder slurry 33. The prefabricated concrete block 31 is a cylindrical prefabricated member, and a spiral groove is formed on an outer circle of the prefabricated concrete block so as to realize the fixation of the soil with the concrete block of the integrated base. Two fixation nuts are disposed on the embedded bolt 32. That is, during the on-site arrangement of the pump, adjusting nuts are horizontally corrected on the prefabricated concrete block, and the concrete is secondarily poured on the bottom plate after calibration so that inlet and output pipelines are connected.

Installation Method:

1. Preparing a pit at a selected pump mounting position on site, and the pit is deepened by 300 mm according to the plane of the pump and the height of the prefabricated concrete member. The diameter of the pit is 300 mm greater than that of the prefabricated member, and the bottom surface thereof is compacted.

2. Placing the concrete dry power on the bottom and compacted, and then placing the circular prefabricated concrete member thereon. After levelling, placing the pump on the bolt of the prefabricated member, and screwing the nut for levelling. The pump can be horizontally levelled by the upper and lower nuts. After fixing the pump by tightening the nut, pouring concrete secondarily, and filling the soil around the prefabricated concrete member.

3. Linking the feed pipeline, the discharge pipeline, the gate valve, the check valve, the flow meter and the like by clamps and fixing on the water injection manifold.

During the installation of the feed and discharge manifolds 40, the single-well vertical water injection pump can be disposed on a water injection manifold on the edge of an oil well tree. The liquid feed flange 28 of the vertical water injection pump is linked with a gate valve 41 through a clamp 43 and is then provided with an elbow. The feed pipeline 42 $\hat{1}$ can be linked with a low-pressure pipeline for water distribution to serve as a low-in-high-out water feed source; or, $\hat{2}$ can linked with a cut of a gate valve 47 in a high-pressure water injection pipeline to serve as a water feed source for boosting water injection. The pressure is boosted (by 4-16 MPa) by the vertical water injection pump. The liquid discharge flange 29 of the vertical water injection pump is linked with a check valve 44, a high-pressure pipeline 45, an elbow, a high-pressure gate valve 46 and the other end of the cut of the high-pressure pipeline gate valve 47 in the water injection manifold through clamps. When the water injection pump is augmented, the high-pressure medium is injected into the high-pressure water injection manifold, so that the augmented injection is realized, as shown in FIG. 10.

The oil field single-well vertical water injection pump is operated as follows.

The oblique plate 2 on the pump is driven by the power source 17 to rotate, so that the thrust ball bearing 3 on the slope is rotated to form a cam stroke. The centralizing sleeve 40 is pushed to transfer the rotation to ball 3 that slides. The pull rods 5 move down to push the plungers to the front dead point, and the liquid discharge valve is switched off. When the oblique plate 2 finishes a turn and moves up from the oblique angle at the lowest position, the spherical surface in the center of the pull-back plate 6 clings to the convex spherical surface of the adjustable ball bearing 7. The rotation of the oblique plate 2 drives the adjustable ball bearing 7, and the pull-back plate 6 does a reciprocating motion along with the plungers and shifts and slides on the spherical surface of the outer circle of the adjustable ball bearing 7, so that the cam profile formed by the rotation of the oblique plate 2 allows the pull rods 5 and the plungers 25 to do a reciprocating motion in the stroke. The concave spherical surface on the plane of the pull-back plate 6 clings to the convex spherical surfaces of the pull rods 5 to lift up the pull rods 5 to the rear dead point, the liquid feed valve is switched on, and the liquid enters the valve cavity. At this time, the liquid enters the first cylinder, the liquid in the second cylinder is discharged, and the liquid begins to be discharged from the third cylinder, thereby realizing reciprocating circulation.

Embodiment 2: this embodiment mainly differs from Embodiment 1 in that: a mechanism capable of controlling and adjusting the assembly gaps among the pull rods, the centralizing sleeve and the oblique plate and the gaps generated during their operation, and a sliding seat in sliding fit with the pull rods are additionally provided at the power head.

Figure 11:
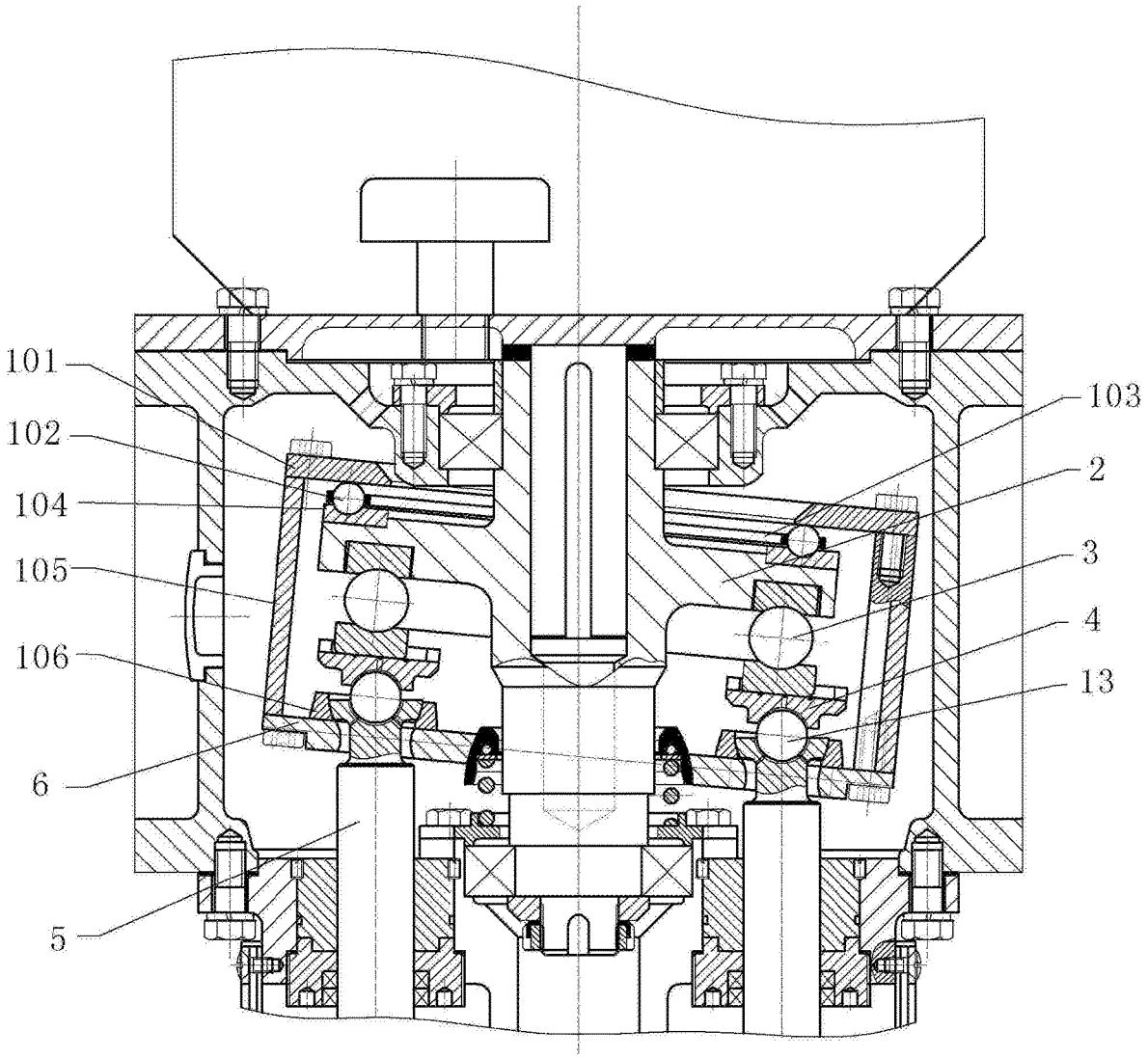
FIG. 11 is a sectional view showing the structure of a power head according to Embodiment 2 of the present invention.
Figure 12:
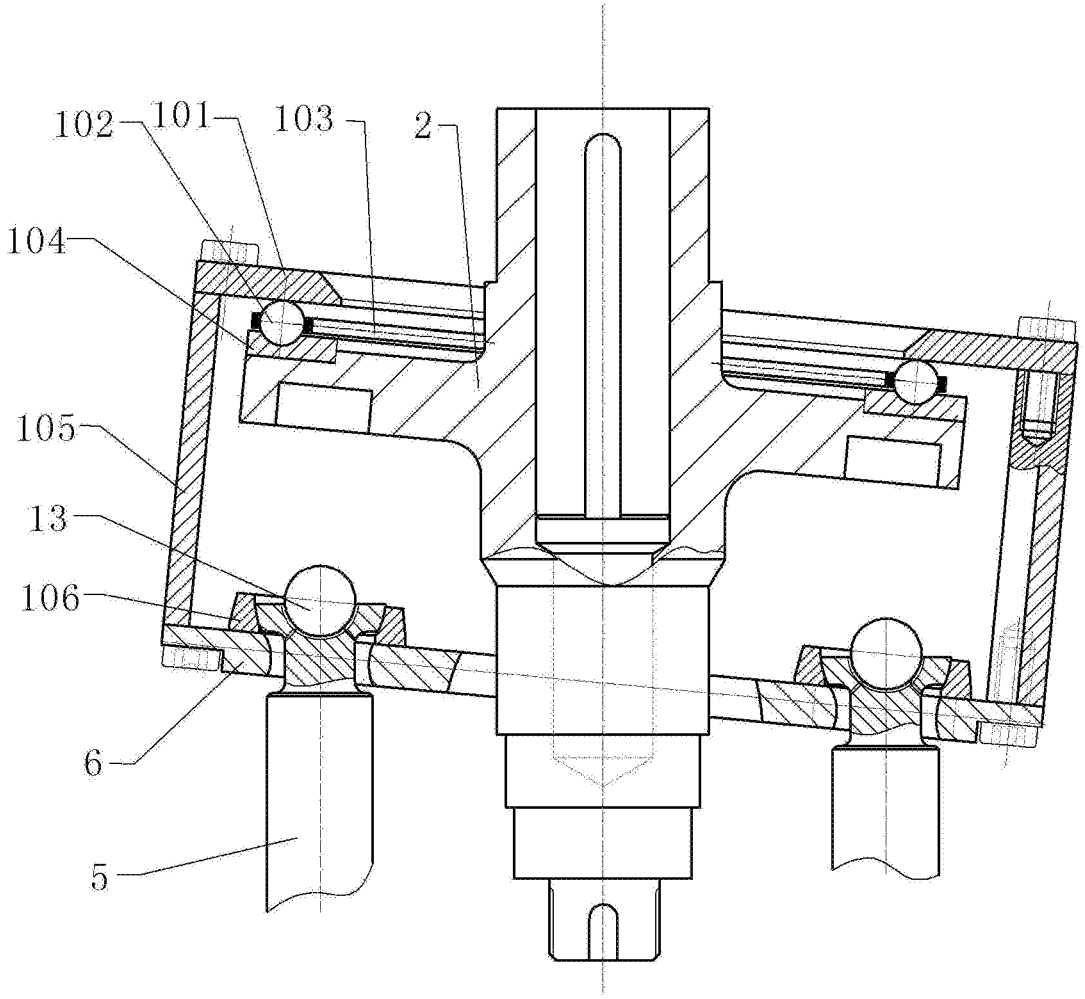
FIG. 12 is a sectional view showing the structure between a positioning sleeve, an oblique plate and a pull-back plate according to Embodiment 2 of the present invention.
Figure 13:
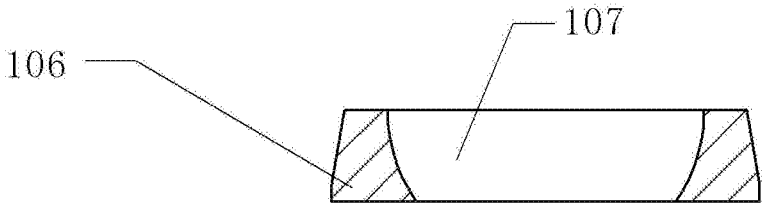
FIG. 13 is a sectional view showing the structure of a sliding seat according to Embodiment 2 of the present invention.

Specifically, as shown in FIGS. 11-13, the mechanism mainly includes a positioning sleeve 105, and a planar bearing device consisting of an upper bearing rail 101, steel balls 102, a synchronous-rotation bearing seat 104 and the like. The positioning sleeve 105 is a cylinder with two open ends and is sheathed outside the oblique plate 2, the centralizing sleeve 4 and the like. A lower end surface of the positioning sleeve 105 is resisted against an outer edge of the pull-back plate 6 and fixed with it through a bolt, so that the positioning sleeve 105 can reciprocate up and down along with the pull-back plate 6.

The planar bearing device consisting of the upper bearing rail 101, the steel balls 102, the synchronous-rotation bearing seat 104 and the like is similar to the planar bearing in structure, and is disposed on the back of the oblique plate 2. Specifically, an annular groove is additionally formed on an outer slope of the planar cam portion 201 of the oblique plate 2, and the bearing seat 104 is disposed inside the groove and can synchronously rotate with the oblique plate 2. The annular spherical groove of the bearing seat 104 is filled with the steel balls 102, and a holder 103 is disposed in the middle of the annular spherical groove. The upper bearing rail 101 is disposed on the steel balls 102, and the steel balls can roll and slide on the plane of the upper bearing rail 101. An upper end face of the positioning sleeve 105 is pressed by the bottom surface of the upper bearing rail 101, and the both are fixed by a bolt. In this way, the pull-back plate 6 and the oblique plate 2 are fixed as a whole by the positioning sleeve 105. A gap pad (not shown) can also be disposed between the upper bearing rail 101 and the positioning sleeve 105. The number of gap pads required is determined according to the requirements for the axial gap.

Additionally, a sliding seat 106 is disposed between each pull rod 5 and the pull-back plate 6. The direct sliding fit mode of the pull-back plate 6 and the pull rods 5 in Embodiment 1 is changed, and the convex spherical head portions of the pull rods 5 are fitted with the sliding seats 106. Specifically, the sliding seats 106 are disposed on the pull-back plate, and are able to slide. Each of the sliding seats 106 is a circular truncated cone with an axial through hole 107 (as shown in FIG. 13), and the inner wall of the through hole 107 is a concave spherical surface. The convex spherical head portions of the pull rods 5 are exposed from the through holes of the pull-back plate (the through holes are unnecessarily designed as spherical through holes as in Embodiment 1), and then fall in the through holes 107 on the sliding seats so that the rotary sliding fitting of the pull rods with the sliding seats is realized. In this way, the elliptic error caused during the synchronous reciprocation of the pull-back plate 6 and the oblique plate 2 can be adjusted by the sliding seats 106, and it is ensured the pull rods 5 do not interfere with the centralizing sleeve 4 during operation.

The assembly gaps among the moving members and the gaps generated during their operation can be adjusted and controlled by the power head in this embodiment. By the structure of synchronously reciprocating the pull-back plate and the oblique plate, the synchronous pullback of the plungers is ensured, the stroke loss is reduced greatly, and the pump efficiency is improved greatly.

What is claimed is:

1. A power head of a vertical reciprocating pump with multi-spherical connection, comprising:

a machine body which has a vertical cylinder shape;

an oblique plate which is connected to an output shaft of a power source and has a shaft portion and a planar cam portion which is beveled;

a centralizing sleeve which is disposed below the planar cam portion of the oblique plate, a thrust ball bearing being disposed between opposite surfaces of the centralizing sleeve and the oblique plate;

an adjustable ball seat which is slidingly disposed on the shaft portion of the oblique plate, and a bottom of which is provided with a reset spring capable of automatically resetting the adjustable ball seat;

a pull-back plate, which is disc shaped and has a plurality of through holes uniformly distributed along the circumference, the pull-back plate being disposed below the centralizing sleeve and mounted on the adjustable ball seat, and the adjustable ball seat being in spherical sliding fit with the pull-back plate;

pull rods, a number of which is the same as a number of plungers of hydraulic ends, each of the pull rods having a lower end connected to a plunger of each of the hydraulic ends of the reciprocating pump and an upper end arranged in a through hole on the pull-back plate, head portions of the pull rods being convex spherical surfaces capable of rotating and sliding, and opposite surfaces of the pull rods and the centralizing sleeve being linked by movable balls;

wherein, the oblique plate, the centralizing sleeve, the adjustable ball seat, the pull-back plate and the pull rods are all disposed in the machine body, and an upper portion of the machine body is connected to a power source while a lower portion thereof is connected to the hydraulic ends of the reciprocating pump; and, under rotation of the oblique plate, the pull-back plate is driven to swing up and down during its reciprocating motion by the thrust ball bearing, the centralizing sleeve and the movable balls, so that the pull rods and the plungers are driven to reciprocate up and down, wherein the power head further comprises:

a positioning sleeve, which is sheathed outside the oblique plate and the centralizing sleeve, and a lower end of which is fixed to the pull-back plate;

a planar bearing device, which is disposed on an outer slope of the planar cam portion of the oblique plate, and the planar bearing device comprises a synchronous-rotation bearing seat disposed on the outer slope, an upper bearing rail and a steel ball disposed on a holder between the bearing seat and the upper bearing rail;

the upper bearing rail and an upper end of the positioning sleeve are fixed together, in this way, the pull-back plate and the oblique plate are fixed as a whole by the positioning sleeve;

a gap pad disposed between the upper bearing rail and the positioning sleeve according to a requirement of an axial gap.

2. The power head of a vertical reciprocating pump of claim 1, wherein a sliding seat is disposed between the pull-back plate and each of the pull rods, and a concave spherical surface in sliding fit with the convex spherical head portion of said each of the pull rods is formed on the sliding seat.

3. The power head of a vertical reciprocating pump of claim 1, wherein the planar cam portion of the oblique plate has a uniform-thickness structure, and a groove for accommodating the thrust ball bearing is formed on an inner slope of the planar cam portion;

one of two ends of the shaft portion is positioned in an inner hole of the machine body and the other of the two ends of the shaft portion is positioned in an inner hole of the pump body at the hydraulic end, and an inner hole and an inner key, to which an output shaft of a motor is directly connected, are formed on the top of the shaft portion; and, upper and lower bearings are disposed on an outer diameter of the shaft portion.

4. The power head of a vertical reciprocating pump of claim 3, wherein the centralizing sleeve is an annular ring having an upper plane and a lower plane;

a groove is formed on the upper plane for accommodating a lower seat of the thrust ball bearing; and, hemispherical surfaces are formed on the lower plane for accommodating the movable balls.

5. The power head of a vertical reciprocating pump of claim 1, wherein a convex spherical surface of the adjustable ball seat is in sliding fit with a spherical surface of the pull-back plate;

a number of self-rotating rollers are disposed on a lower end surface of the adjustable ball seat to form a planar bearing;

accordingly, an inner hole in the center of the pull-back plate has an inner spherical surface that is in fit with the convex spherical surface of the adjustable ball seat.

6. The power head of a vertical reciprocating pump of claim 1, wherein the convex spherical head portions of the pull rods are hemispheres, and hemispherical surfaces for accommodating the movable balls are formed on upper planes of the convex spherical head portions.

7. A water injection pump, wherein the water injection pump comprising:

a power head of claim 1;

a hydraulic end of the hydraulic ends integrally linked with the power head, the hydraulic end comprises;

a pump body, in which plungers and combined valves each having a liquid feed valve and a liquid discharge valve integrated with each other are disposed according to a number of cylinders;

an annular liquid feed cavity and an annular liquid discharge cavity are disposed at a lower central portion of the pump body;

the annular liquid feed cavity is communicated with a suction port of each of the combined valves;

the annular liquid discharge cavity is disposed below the annular liquid feed cavity and communicated with a liquid discharge port of each of the combined valves;

a liquid feed flange and a liquid discharge flange, which are respectively connected to external feed and discharge manifolds, are arranged on an outer circle of the pump body; and an integrated base, by which the water injection pump is integrally mounted at a predetermined position.

8. The water injection pump of claim 7, wherein the feed manifold and the discharge manifold are connected to a water injection manifold on an edge of an oil well tree;

the liquid feed flange is linked with a high-pressure pipeline gate valve in a low-pressure pipeline or with the water injection manifold through a gate valve, an elbow and a feed pipeline serve as a low-in-high-out or high-in-high-out water feed source and an inlet for linking the water injection pump, respectively; and, the liquid discharge flange is connected to the high-pressure pipeline gate valve in the water injection manifold through a check valve, a high-pressure pipeline, the elbow and a high-pressure gate valve, so that high-pressure liquid pressurized in a low-in-high-out or high-in-high-out manner is injected into the water injection manifold.

9. The water injection pump of claim 7, wherein the integrated base comprises a prefabricated concrete block, an embedded bolt and concrete dry powder slurry;

a bottom of the pump body is fixed with the prefabricated concrete block through the embedded bolt;

the prefabricated concrete block is cylindrical, and a spiral groove is formed on an outer circle of the prefabricated concrete block.

10. The water injection pump of claim 7, wherein the pull rods and the plungers are positioned and linked by clamps;

an outer circle of each of the pull rods is cylindrical and each of the pull rods is provided with a sliding sleeve mechanism having a guide effect.

* * * * *